US006250480B1

(12) United States Patent
McGuinness

(10) Patent No.: US 6,250,480 B1
(45) Date of Patent: Jun. 26, 2001

(54) HANDLE SUPPORTING FISHING ROD RACK

(75) Inventor: Justin A. McGuinness, 115 Crestwicke Trace, SW., Atlanta, GA (US) 30319

(73) Assignee: Justin A. McGuinness, Athens, GA (US)

( * ) Notice: Subject to any disclaimer, the term of this patent is extended or adjusted under 35 U.S.C. 154(b) by 0 days.

(21) Appl. No.: 09/363,201

(22) Filed: Jul. 29, 1999

(51) Int. Cl.[7] ..... A47F 7/00
(52) U.S. Cl. ..... 211/70.8; 211/70.6; D6/552
(58) Field of Search ..... D6/552; 211/69, 211/70.6, 70.8, 68, 60.1, 69.5, 74, 65

(56) References Cited

U.S. PATENT DOCUMENTS

D. 169,077 * 3/1953 Mains .
460,445 * 9/1891 Nessler .
838,473 * 12/1906 Speiser .
1,188,146 * 6/1916 Bogley .
2,587,226 * 2/1952 Rodman .
2,815,863 * 12/1957 Larson .
3,004,673 * 10/1961 Emery ..... 211/70.8
3,421,632 * 1/1969 Wood ..... 211/70.8
4,176,819 * 12/1979 Lowe .
4,311,262 * 1/1982 Morin .
4,453,639 * 6/1984 Sharma ..... 211/74
5,129,528 * 7/1992 Eidsmoe et al. ..... 211/70.6
5,617,960 * 4/1997 Bishop ..... 211/60.1
5,657,883 * 8/1997 Badia ..... 211/70.8
5,843,388 * 12/1998 Anvoyo et al. ..... 211/70.6 X

* cited by examiner

*Primary Examiner*—Robert W. Gibson, Jr.

(57) ABSTRACT

A handle supporting fishing rod rack (100) has two spaced apart base members (102), a top member (104) extending between the base members, and at least one bottom member (112) extending between the base members 102. The top member has a plurality of top openings (110), which are top bores 110A or slots (110B), extending therethrough. The at least one bottom member is spaced vertically below the top member and has a plurality of bottom bores (114) extending therethrough which are vertically aligned with the top openings. The at least one bottom member is either positioned substantially parallel to the top member or at an angle with respect to the top member that is downward and outward relative to the base members. Indicia (116) may be displayed on the at least one bottom member to convey a message to a reader. A brace (118) is connected to the top and the at least one bottom members to provide structural support. The bottom member is spaced below the top member such that a bottom bore receives a lower portion of a handle (14) of a fishing rod and reel assembly (10) extended through the respective top opening while either a reel (22) or a finger grip (20) of the assembly rests upon the top member, holding the assembly in a substantially vertical position by the handle.

15 Claims, 4 Drawing Sheets

102
102
112
110
106
4
4
104
110A
110A
110
100
112
102
102

110
118
106
108
114
114
112
116
10
16
12
20
22
14

HANDLE SUPPORTING FISHING ROD RACK

FIELD OF INVENTION

The present invention relates to rack structures, and more particularly to a fishing rod support rack which vertically supports a fishing rod and reel assembly without contacting the fishing rod blank.

BACKGROUND OF THE INVENTION

Fishing rods typically comprise a handle or hand grip, a blank extending outwardly from the handle, line guides positioned along the length of the blank, and a finger grip extending outwardly and substantially perpendicularly from the handle. Reels are commonly mounted to the fishing rod proximate the intersection of the handle and the blank to form a fishing rod and reel assembly. Storage and/or display of fishing rod assemblies have been problematic. Fishing rods, particularly fresh water fishing rods, can warp if improperly stored, such as leaning the fishing rods against a wall for prolonged periods of time.

In response to this problem, the fishing rod industry developed many fishing rod storage racks that are known in the prior art. These fishing rod storage racks support fishing rods in either a horizontal position, stacked one on top of another, or a vertical position, wherein the fishing rods are disposed side by side.

The horizontal racks generally consist of a pair of horizontally spaced apart lateral sides having vertically disposed slots or protruding arms to provide cradles for receiving and supporting the fishing rods. One cradle typically removably engages and supports the handle or a lower portion of the blank and the mating cradle invariably removably engages and support an upper portion of the blank. Such fishing rod storage racks are often wall-mounted.

Vertical positioning fishing rod storage racks can be either wall-mounted or free-standing. One example of a wall-mounted fishing rod support rack is described in U.S. Pat. No. 5,257,700 to Wallace. This rack has upper and lower wire frames. The lower frame has a continuous wire hoop, a wire shelf assembly, and a plurality of bent wire loops. The upper frame has a continuous wire hoop and a plurality of bent wire loops. The tip end of the fishing rod blank is passed through a selected loop of the upper frame from below. The blank is advanced through the selected loop until the butt end of the handle is positioned at an elevation higher than the vertically aligned loop of the lower frame. The butt end of the handle is lowered through the loop of the lower frame until the butt end engages and rests upon the upper surface portions of the shelf assembly. The fishing rods are maintained in a vertical position by the loops of the upper frame engaging the upper portion of the rod blanks. Another example of a wall-mounted fishing rod rack is disclosed by Winkler, Jr. et al. in U.S. Pat. No. 5,588,542. In a similar fashion, this rack includes a lower engaging assembly mountable to a vertical wall surface for receiving a handle of a fishing rod. An upper engaging assembly is mountable to the vertical wall surface spaced from the lower engaging assembly for receiving an upper end of the fishing rod blank so as to support the fishing rod in cooperation with the lower engaging assembly. The upper engaging assembly includes a fixed upper support plate and a pivoting upper support plate that opens to facilitate positioning of the upper end of the rod blank into an aperture directed through the support plates. Optionally, U-shaped clips are pivotally mounted within the individual apertures to removably engage and assist in securing the rod blanks.

Free-standing fishing rod racks typically consist of two spaced apart side boards and three vertically spaced apart members. An upper member has notches to receive and removably engage the fishing rod blanks. An intermediate member is positioned forwardly with respect to the upper member and at an elevation to removably engage the fishing rod handles. A lower, angle board member is positioned vertically below and angled with respect to the upper member. That is, the angle board is downward and outward relative to the side boards. Blanks of the fishing rods are received in the notches and the butts of the handles are rested on the angle board, which urges the fishing rods outwardly to create a shear between the angle board and the respective fishing rods. This in turn urges the handles forwardly against the intermediate board and the blanks rearwardly into the notches to engage the upper member and secure the fishing rods in a vertical position.

A variation of the rack discussed immediately above is described in U.S. Pat. No. 5,657,883. In this fishing rod support rack, the intermediate member is positioned vertically below the upper member and has a plurality of holes therein to removably receive the fishing rod handles. The angle board creates the aforementioned shear and urges the fishing rod blanks rearwardly into the notches and against the upper member and the fishing rod handles forwardly against the intermediate member within the holes.

Another type of free-standing fishing rod support rack consists of a lower support platform and an upper support platform. The lower support platform has spaced apart cylindrically shaped grooves or cups to removably receive and support the butts of the fishing rod handles. The upper support platform is vertically disposed above the lower support platform and has aligned clips to removably grasp the fishing rod blanks and hold the fishing rods in a vertical position. In another embodiment of this rack, the upper support platform has notches and the notches are positioned rearwardly with respect to the grooves or cups such that the fishing rod blanks are leaned into the grooves and urged in place by gravity.

Commonly, all of the known fishing rod support racks require a relatively large amount of space and, more importantly, require contact with the fishing rod blank. Contact with the fishing rod blank is undesirable because it risks damage to the blank through cuts, scratches, or marring. Damages of these types create a weak point on the fishing rod blank, which can lead to untimely failure and breakage of the fishing rod at such weakened point when the rod is placed under stress, such as when a fish is on the line.

Accordingly, there is a need for a fishing rod support rack which supports fishing rods in a vertical position without any touching of the fishing rod blanks. Further, there is a need for a fishing rod support rack which occupies less space than a comparable conventional fishing rod support rack that holds a like number of fishing rod and reel assemblies. The present invention is directed to overcoming these deficiencies in the art.

SUMMARY OF THE INVENTION

A handle supporting fishing rod rack of the present invention has two spaced apart base members, a top member extending between the base members, and at least one bottom member extending between the base members. The top member has a top surface, a bottom surface, and a plurality of top openings, which are either slots or top bores, extending through the top member between the top and bottom surfaces. Preferably, the top and bottom surfaces are substantially planar. The at least one bottom member is spaced vertically below the top member and has a plurality of bottom bores extending therethrough. Indicia may be displayed on the at least one bottom member to convey a message to a reader. A brace is positioned between the base members and connected to the top and the at least one bottom members to provide structural support to the rack. For each top opening of the top member, the at least one bottom member has a respective bottom bore. The respective top openings and bottom bores are preferably vertically aligned with each other. Importantly, the bottom member is spaced below the top member such that a bottom bore receives a lower portion of the handle of a fishing rod and reel assembly extending through the respective top opening while either the reel or the finger grip rests upon the top surface of the top member. In this manner, the fishing rod rack holds the fishing rod and reel assembly in a substantially vertical position by the handle without contacting the blank. Because the fishing rod rack does not engage any portion of the blank, the height of the fishing rod rack is substantially less than conventional fishing rod racks.

In one embodiment of the fishing rod rack, the at least one bottom member is positioned at an angle with respect to the top member that is downward and outward relative to the base members. The bottom bores are substantially cylindrically shaped and extend along an axis which is substantially perpendicular to the top member to form a high contact point and a low contact point for removably engaging the lower portion of the handle. In another embodiment, the top and the at least one bottom members are substantially parallel to each other.

DETAILED DESCRIPTION OF THE INVENTION

Figures 1, 9:
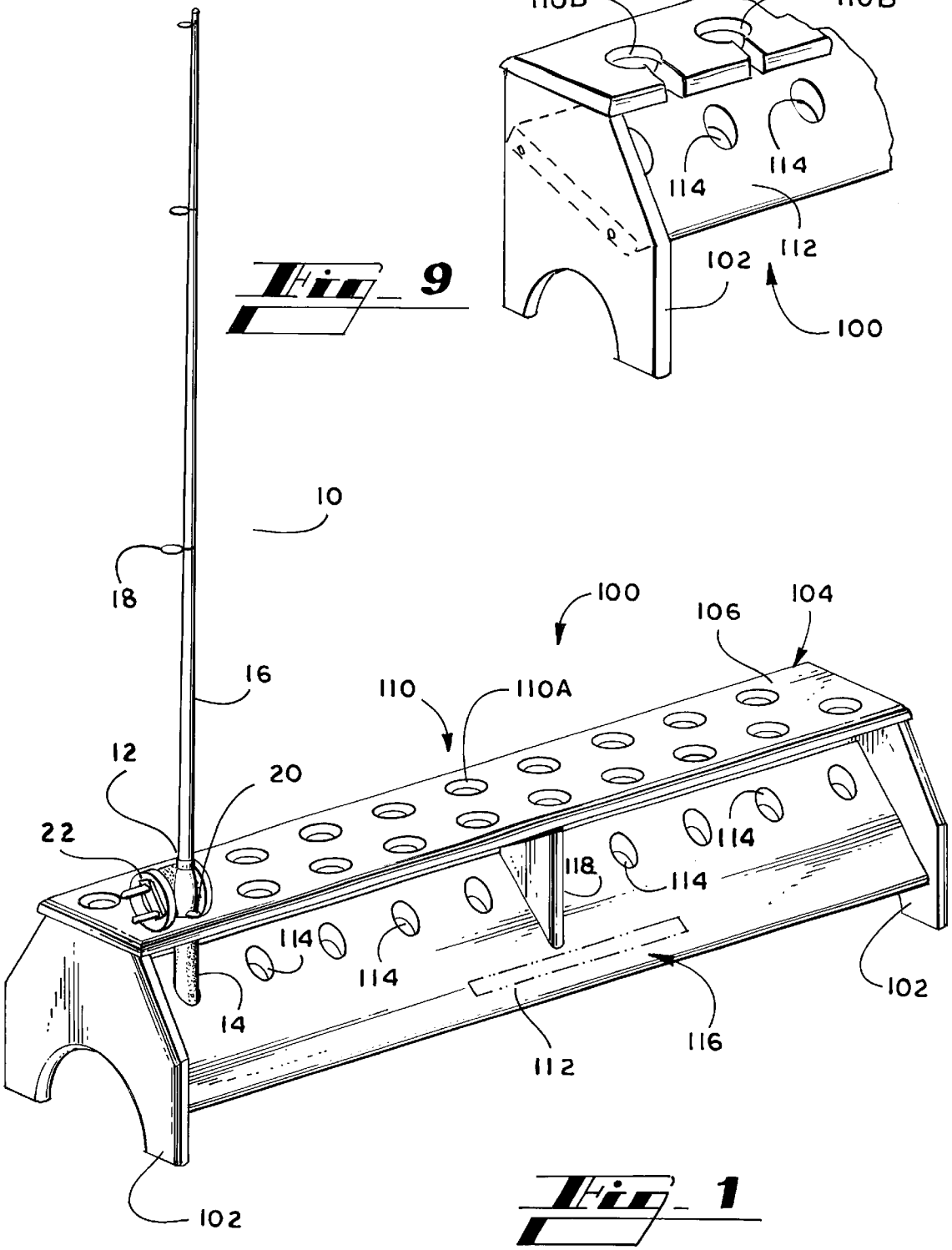
FIG. 1 is a perspective view of an embodiment of a handle supporting fishing rod rack made in accordance with the present invention.
FIG. 9 is a partial, perspective view of even yet another embodiment of a fishing rod rack made in accordance with the present invention.

For a fuller understanding of the present invention, reference should be made to the following detailed description taken in connection with the accompanying drawings. Referring to the drawings wherein like reference numerals designate corresponding parts throughout the several figures, reference is made first to FIG. 1. FIG. 1 illustrates an embodiment of a handle supporting fishing rod rack 100 made in accordance with the present invention providing substantially vertical support to a fishing rod and reel assembly 10. A fishing rod and reel assembly 10 typically comprises a fishing rod 12 with a reel 22 mounted thereto. The fishing rod commonly consists of a handle 14 or hand grip, a blank 16 extending outwardly from the handle 14, line guides 18 positioned along the length of the blank 16, and a finger grip 20 extending outwardly and substantially perpendicularly from the handle 12 proximate the intersection of the blank 16. Fishing rod and reel assemblies 10 supported by the fishing rod rack 100 of the present invention are conventional, not a part of the present invention, and described only for illustrative purposes.

Figures 2, 3:
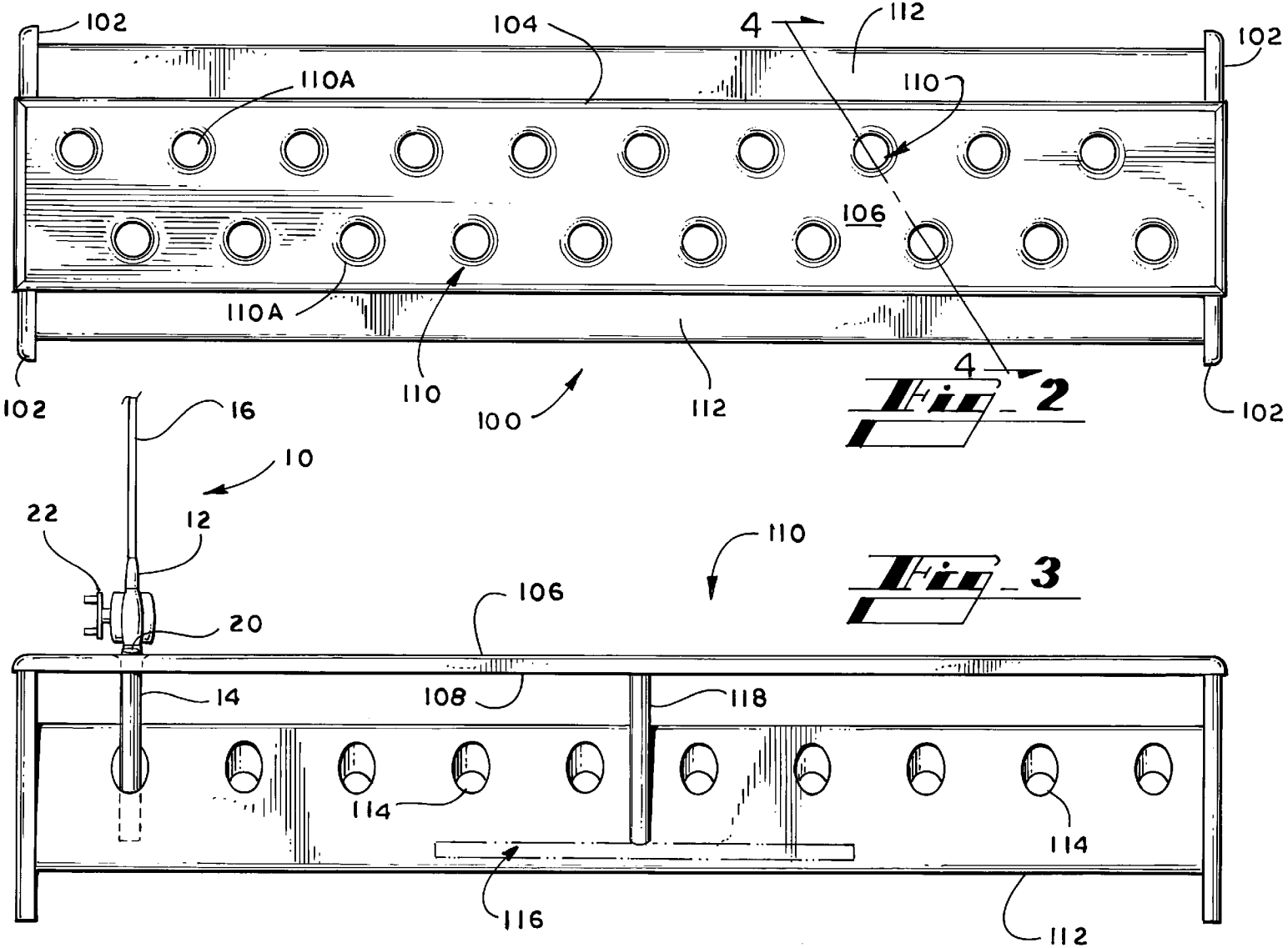
FIG. 2 is a top view of the fishing rod rack of FIG. 1.
FIG. 3 is a side elevation view of the fishing rod rack of FIG. 1.
Figure 4:
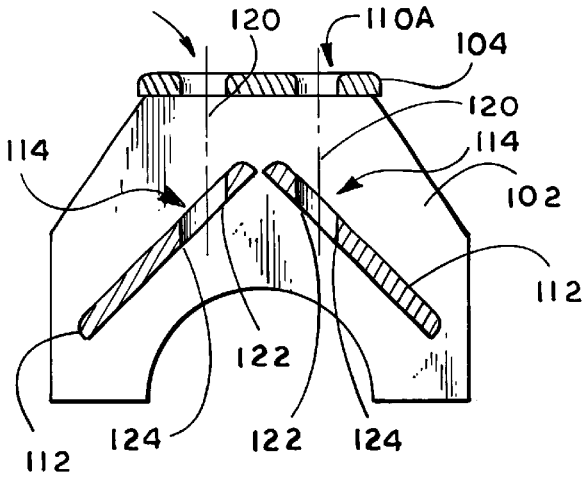
FIG. 4 is a cross-sectional view taken along line 4—4 of FIG. 1.
Figure 5:
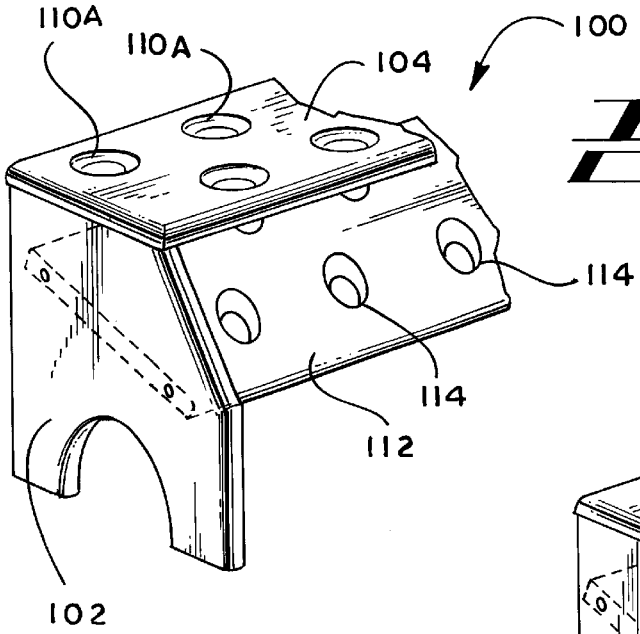
FIG. 5 is a partial, perspective view of another embodiment of a fishing rod rack made in accordance with the present invention.
Figure 6:
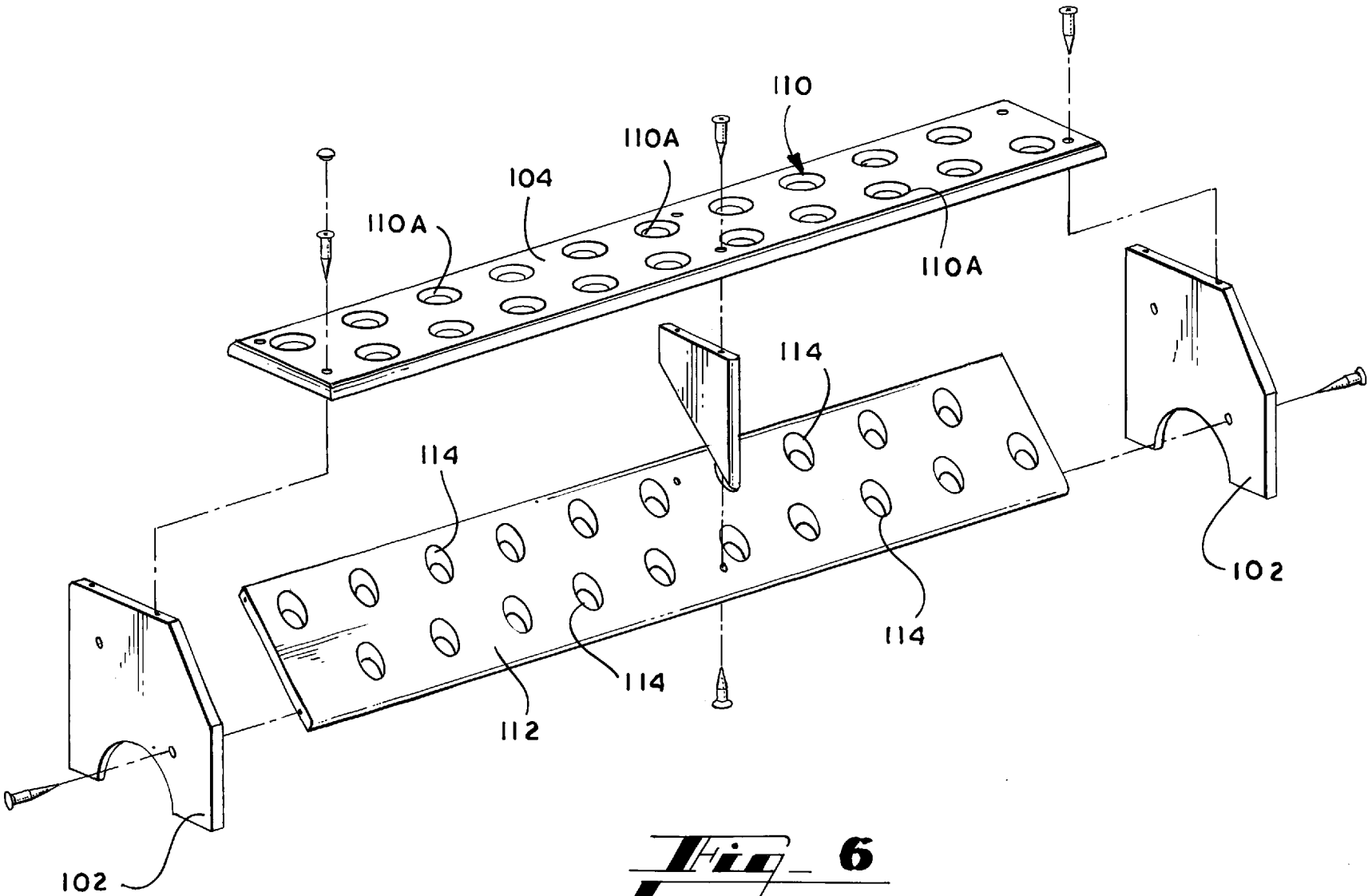
FIG. 6 is a perspective, exploded view of the fishing rod rack of FIG. 5.

With continued reference to FIG. 1 and additionally to FIGS. 2–9, a fishing rod rack 100 of the present invention has two spaced apart base members 102, a top member 104 mounted to and extending between the base members 102, and at least one bottom member 112 also mounted to and extending between the base members 102. The top member 104 has a top surface 106, a bottom surface 108, and a plurality of top openings 110 extending through the top member 104 between the top and bottom surfaces 106 and 108. As shown in FIGS. 1 and 3–8, the top openings 110 are top bores 110A. In FIG. 9, the top openings 110 are slots 110B. Preferably, the top and bottom surfaces 106 and 108 are substantially planar. The at least one bottom member 112 is spaced vertically below the top member 104 and has a plurality of bottom bores 114 extending therethrough. As shown generally in FIG. 1, indicia 116 may be displayed on the at least one bottom member 112 to convey a message to a reader. A brace 118 is positioned between the base members 102 and connected to the top 104 and the at least one bottom member 112 to provide structural support to the rack 100. For each the top opening 110 of the top member 104, the at least one bottom member 112 has a respective bottom bore 114. As shown in FIGS. 2, 4, and 6, the respective top openings 110 and bottom bores 114 are vertically aligned with each other. It is preferred for the top and bottom bores 110A and 114 to have a 1⅜ inch diameter. Further, it is preferred for adjacent top bores 110A to be spaced 5 inches apart from center to center. Importantly, as illustrated in FIG. 3, the bottom member 112 is spaced below the top member 104 such that a bottom bore 114 receives a lower portion of the handle 14 of a fishing rod and reel assembly 10 inserted through the respective top opening 110 while either the reel 22 or the finger grip 20 rests upon the top surface 106 of the top member 104. In this manner, the fishing rod rack 100 holds the fishing rod and reel assembly 10 in a substantially vertical position by the handle without contacting the blank 16. Because the fishing rod rack 100 does not engage any portion of the blank 16, the height of the fishing rod rack 100 is substantially less than conventional fishing rod racks. This results in the fishing rod rack 100 of the present invention being more compact and occupying less vertical space than conventional fishing rod support racks that support an equal number of fishing rod and reel assemblies.

Referring again to FIG. 1 and additionally to FIGS. 2–4, this embodiment of the fishing rod rack 100 has two bottom members 112 disposed beneath the top member 104 The top member 104 has two rows of top bores 110A. Each bottom member 112 has a respective brace 118 mounted thereto. As mentioned above, the top and bottom surfaces 106 and 108 of the top member 104 are substantially planar. Each bottom member 112 is positioned at an angle with respect to the top member 104 that is downward and outward relative to the base members 102 to form an inverted V, as indicated in FIG. 4. Preferably, the bottom members 112 are positioned at a 45° angle with respect to the base members 102. Also as shown in FIG. 4, the bottom bores 114 are substantially cylindrically shaped, thereby having a central axis 120. Preferably, the bottom bores 114 are vertically aligned with the top bores 110A and positioned so that the respective central axes 120 are spaced 5 inches apart. The central axis 120 of each bottom bore 114 is substantially perpendicular to the top member 104. This results in the bottom bores 114 having a high contact point 122 and a low contact point 124 for removably engaging the lower portion of the handle 14. As particularly shown in FIG. 4, the high and low contact points 122 and 124 are at different vertical elevations. As a result, this embodiment of the fishing rod rack 100 utilizes two members 104 and 112 to provide removable engagement with the handle 14 along three vertically spaced apart contact points, that is, the top surface 106 of the top member 104 and the high and low contact points 122 and 124, to support the fishing rod and reel assembly 10 in a vertical position. In contrast, conventional fishing rod support racks utilize three members to provide three vertically spaced apart contact points, wherein at least one of the contact points engages the blank 16.

Now, referring to FIGS. 5 and 6, another embodiment of the fishing rod rack of the present invention is shown. Similar to the embodiment of FIGS. 1–4, the top member has two rows of top bores 110A which are preferably spaced 5 inches apart from center to center. This embodiment employs a single bottom member 112 which matingly has two rows of bottom bores 114. The bottom member 112 is positioned at an angle with respect to the top member 104 that is downward and outward relative to the base members 102, as indicated in FIG. 5. Preferably, the bottom member 112 is positioned at a 45° angle with respect to the base members 102. Each bottom bore 114 has high and low contact points 122 and 124, as shown in FIG. 4 and described above. Preferably, the bottom bores 114 are vertically aligned with the top bores 110A and positioned so that the respective central axes 120 are spaced 5 inches apart.

Figure 7:
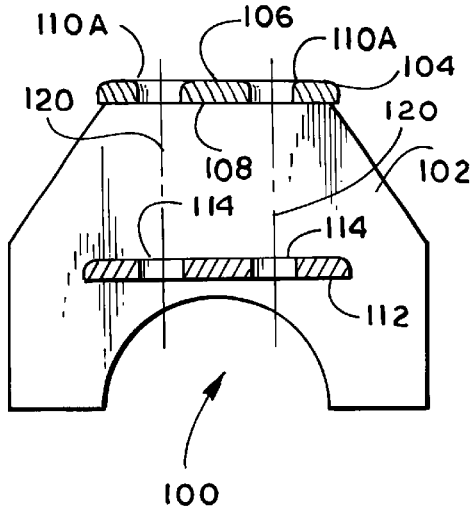
FIG. 7 is a cross-sectional view of yet another embodiment of a fishing rod rack made in accordance with the present invention, wherein a bottom member is substantially parallel to a top member.

In the embodiment of the fishing rod rack shown in FIG. 7, the top member 104 has substantially planar top and bottom surfaces 106 and 108 and two rows of top bores 110A. In this embodiment, the bottom member 112 is substantially planar and parallel to the top member 104.

Figure 8:
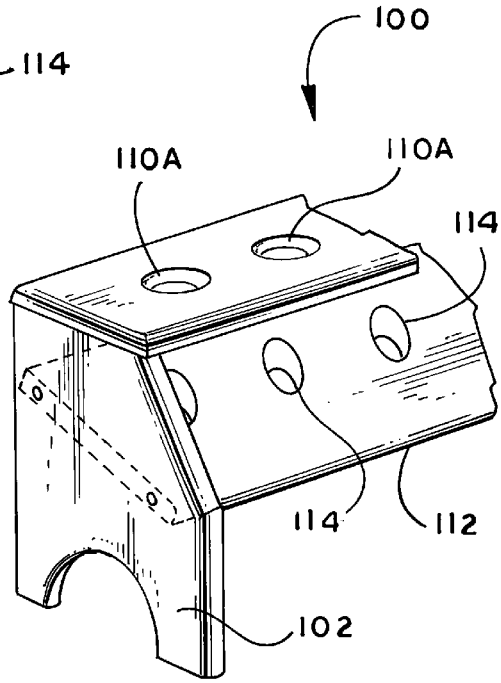
FIG. 8 is a partial, perspective view of still another embodiment of a fishing rod rack made in accordance with the present invention.

Referring to FIG. 8, this embodiment of the fishing rod rack 100 has a top member 104 which has a single row of top bores 110A. The bottom member 112 is positioned at an angle with respect to the top member 104 that is downward and outward relative to the base members 102. Each bottom bore 114 has high and low contact points 122 and 124, as shown in FIG. 4 and described above. Preferably, the bottom bores 114 are vertically aligned with the top bores 110A and positioned so that the respective central axes 120 are spaced 5 inches apart.

Now, referring to FIG. 9, this embodiment of the fishing rod rack is similar to the embodiment of FIG. 8, with the exception that the top openings 110 are slots 110B.

In use, a handle 14 of a fishing rod and reel assembly 10 is inserted initially through a top opening 110. The handle 14 continues through the respective bottom bore 114 of the fishing rod rack 100 until the reel 12 or the finger grip 20 contacts the top surface 106 of the top member 104, thereby holding the fishing rod in a substantially vertical position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Further, the various components of the embodiments of the invention may be interchanged to produce further embodiments and are these further embodiments are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed:

1. A fishing rod rack for supporting fishing rod and reel assemblies, each fishing rod having a blank, a finger grip, and a handle, the fishing rod rack comprising:

two spaced apart base members;

a top member extending between the base members and having a plurality of top openings therethrough for respectively receiving the handle; and at least one bottom member extending between the base members, having a plurality of bottom bores therethrough, and spaced vertically below the top member and positioned at an angle with respect to the top member that is downward and outward relative to the base members, each bottom bore positioned substantially vertically below a respective top opening such that each bottom bore is capable of receiving a lower portion of the handle extending through the respective top opening while either the reel or the finger grip rests upon the top member to hold the rod in a substantially vertical position.

2. A fishing rod rack according to claim 1, further comprising a brace positioned between the base members and connected to the top and the at least one bottom members to provide structural support to the rack.

3. A fishing rod rack according to claim 1, wherein the top member is substantially planar and at least one bottom bore is substantially cylindrically shaped, has a central axis which is substantially perpendicular to the top member, and has a high contact point and a low contact point for removably engaging the lower portion of the handle.

4. A fishing rod rack according to claim 1, wherein the top member and the at least one bottom member are substantially parallel to each other.

5. A fishing rod rack for supporting a fishing rod and reel assembly, the fishing rod having a blank, a finger grip, and a handle, the fishing rod rack comprising:

two spaced apart base members;

a top member extending between the base members and having at least one top opening therethrough for receiving the handle;

at least one bottom member extending between the base members, having at least one bottom bore therethrough, and spaced vertically below the top member such that the at least one bottom bore receives a lower portion of the handle extending through the top opening while either the reel or the finger grip rests upon the top member, whereby the rod is held in a substantially vertical position; and indicia displayed on the at least one bottom member to convey a message to a reader.

6. A fishing rod rack according to claim 1, wherein the top opening is a slot or a top bore.

7. A fishing rod rack according to claim 1, wherein at least one top opening and at least one bottom bore are in alignment with each other.

8. A fishing rod rack for supporting fishing rod and reel assemblies, each fishing rod having a blank, a finger grip, and a handle, the fishing rod rack comprising:

two spaced apart base members;

a top member extending between the base members and having a plurality of top openings therethrough for respectively receiving the handle; and at least one bottom member extending between the base members and positioned at an angle with respect to the top member, having a plurality of bottom bores therethrough, and spaced vertically below the top member, each bottom bore positioned substantially vertically below a respective top opening such that each bottom bore is capable of receiving a lower portion of the handle extending through the respective top opening while either the reel or the finger grip rests upon the top member to hold the rod in a substantially vertical position.

9. A fishing rod rack according to claim 8, further comprising a brace positioned between the base members and connected to the top and the at least one bottom members to provide structural support to the rack.

10. A fishing rod rack according to claim 8, wherein the top member and the at least one bottom member are substantially parallel to each other.

11. A fishing rod rack according to claim 8, further comprising indicia displayed on the at least one bottom member to convey a message to a reader.

12. A fishing rod rack according to claim 8, wherein the top openings are selected from a slot or a top bore.

13. A fishing rod rack according to claim 8, wherein at least one top opening and at least one bottom bore are in alignment with each other.

14. A fishing rod rack according to claim 8, wherein the at least one bottom bore is substantially cylindrically shaped and has a high contact point and a low contact point for removably engaging the lower portion of the handle.

15. A fishing rod rack according to claim 14, wherein the at least one bottom member is in a position that is downward and outward relative to the base members.

* * * * *